US005739482A

United States Patent [19]

Shima et al.

[11] Patent Number: 5,739,482

[45] Date of Patent: Apr. 14, 1998

[54] SOUNDPROOF WALL

[75] Inventors: Hiroshi Shima, Kanagawa-ken; Toshiyuki Watanabe, Tokyo, both of Japan

[73] Assignee: Bridgestone Corporation, Tokyo, Japan

[21] Appl. No.: 718,836

[22] Filed: Sep. 24, 1996

[30] Foreign Application Priority Data

Sep. 29, 1995 [JP] Japan ..... 7-276826
Jun. 28, 1996 [JP] Japan ..... 8-188705

[51] Int. Cl.[6] ..... G10K 11/00

[52] U.S. Cl. ..... 181/210

[58] Field of Search ..... 181/210, 284, 181/286, 287; 52/144, 145

[56] References Cited

U.S. PATENT DOCUMENTS

| | | | |
|---|---|---|---|
| 4,158,401 | 6/1979 | Matsumoto et al. | 181/210 |
| 4,308,933 | 1/1982 | Hahn et al. | 181/210 |
| 4,436,179 | 3/1984 | Yamamoto et al. | 181/210 |

FOREIGN PATENT DOCUMENTS

| | | |
|---|---|---|
| 62-160304 | 7/1987 | Japan . |
| 3-199515 | 8/1991 | Japan . |

OTHER PUBLICATIONS

Journal of Sound and Vibration (1994) 177(3), pp. 289–305, "Acoustic Performance of New Designs of Traffic Noise Barriers: Full Scale Tests," by G.R. Watts et al.

Journal of Sound and Vibration (1994) 176(4), pp. 459–473, "The Performance of Multiple Noise Barriers," by D.H. Crombie and D.C. Hothersall.

Journal of Sound and Vibration (1991) 146(2), pp. 303–322, "Efficiency of Single Noise Barriers," by D.C. Hothersall, S.N. Chandler-Wilde and M.N. Hajmirzae.

Applied Acoustics 31 (1990), pp. 77–100, "Mathematical Modeling of Absorbent Highway Noise Barriers," by Sabih I. Hayek.

Applied Acoustics 44 (1995) pp. 353–367, "Multiple-Edge Noise Barriers," by D.H. Crombie, D.C. Hothersall & S.N. Chandler-Wilde.

*Primary Examiner*—Khanh Dang
*Attorney, Agent, or Firm*—Jordan and Hamburg

[57] ABSTRACT

A soundproof wall has a main wall, a first branch wall extending in a substantially vertical direction from a top of the main wall, a second branch wall extending obliquely from the main wall in a direction away from a noise source, and a third branch wall extending obliquely from an intermediate portion of the second branch wall in a direction toward the noise source. Another embodiment of the invention includes a horizontal branch extending from the main wall in a direction away from the noise source and supporting the second branch wall.

2 Claims, 10 Drawing Sheets

SOUNDPROOF WALL

BACKGROUND OF THE INVENTION

The present invention relates to a soundproof wall for use along roads, railways, factories, etc. to attenuate sound or noise coming from such noise sources.

Conventionally, to control an undesired sound or noise from a road, railway, factory, etc., upright or vertical soundproof walls are used widely to prevent the sound from coming directly from its source. Among various noise-control solutions, the vertical soundproof walls are relatively low in cost and effective for attenuation of sounds from various sound sources. For an improved sound attenuation, the soundproof walls should preferably be taller. However, such taller walls are correspondingly more expensive (the taller, the greater the construction costs). Also the taller walls are likely to intercept the sunlight, impair the view and cause an oppressive sensation, poor ventilation, radio interference and turbulent flow.

Further, it has been proposed to use various other types of soundproof walls such as bent-top types whose wall top portion is bent toward the sound source and curved-top types whose wall top portion is curved toward the sound source, if use of only a vertical soundproof wall is not acceptable for the noise problem. However, it is known that the latter types of soundproof walls cause the above-mentioned problems to be more serious.

The recent drastic increase of traffic and higher speed of vehicles have resulted in a serious environmental noise problem. Since no other effective noise control solutions have been proposed, the above-mentioned bent-top and curved-top types of soundproof walls are used in addition to the vertical soundproof walls of 5 m, 7 m and 10 m in height. The above-mentioned environmental-problems remain unsolved.

The conventional soundproof walls only provide an improved sound attenuation by increased wall height. Generally, at a remote place (about 20 meters) from the soundproof wall, the sound attenuation attainable with an increase by 1 m in height of the soundproof wall is only about 1 dB.

Accordingly, soundproof walls provided on the top thereof with auxiliary walls 100 opening upward as shown in FIGS. 17 to 20 have been proposed to enhance the effect of noise control without any increase of the wall height. These prior-art soundproof walls with the auxiliary walls provide a sound attenuation improvement of several decibels (dB) in comparison with the conventional upright or vertical soundproof walls. However, this noise control is not sufficient. Soundproof walls providing further improvement in sound attenuation are demanded from many fields of industry.

SUMMARY OF THE PRESENT INVENTION

Accordingly, the present invention has an object to provide a soundproof wall capable of suppressing noise more effectively without increasing the soundproof wall height.

The above object is accomplished by providing a soundproof wall comprising, according to the present invention, a main wall, a first branch wall installed generally vertically on the top of the main wall, a second branch wall extending obliquely away from the noise source, and a third branch wall installed at an intermediate height of the second branch wall and which extends obliquely upward toward the noise source.

The soundproof wall according to the present invention is designed for use along a noise source as a road, railway, etc. It comprises a main wall, a first branch wall installed generally vertically on the top of the main wall, a second branch wall inclined away from the noise source, and a third branch wall installed at an intermediate height of the second branch wall and which extends obliquely upward toward the noise source. Without increasing height of the soundproof wall, the first branch wall functions to suppress mainly the sound coming directly from the noise source while the second and third branch walls effectively work to attenuate mainly the sound wave diffracted at the top of the first branch wall, thereby enhancing noise control. Also, provision of a sound absorbing material on an inner or outer side of at least one of the first, second and third branch walls further improves the effect of sound attenuation.

These and other objects and advantages of the present invention will be better understood from the ensuing description made, by way of example, of preferred embodiments of the present invention with reference to the drawings.

DETAILED DESCRIPTION OF THE INVENTION

It should be noted that same or like parts are indicated with same or like references throughout the drawings.

Figure 1:
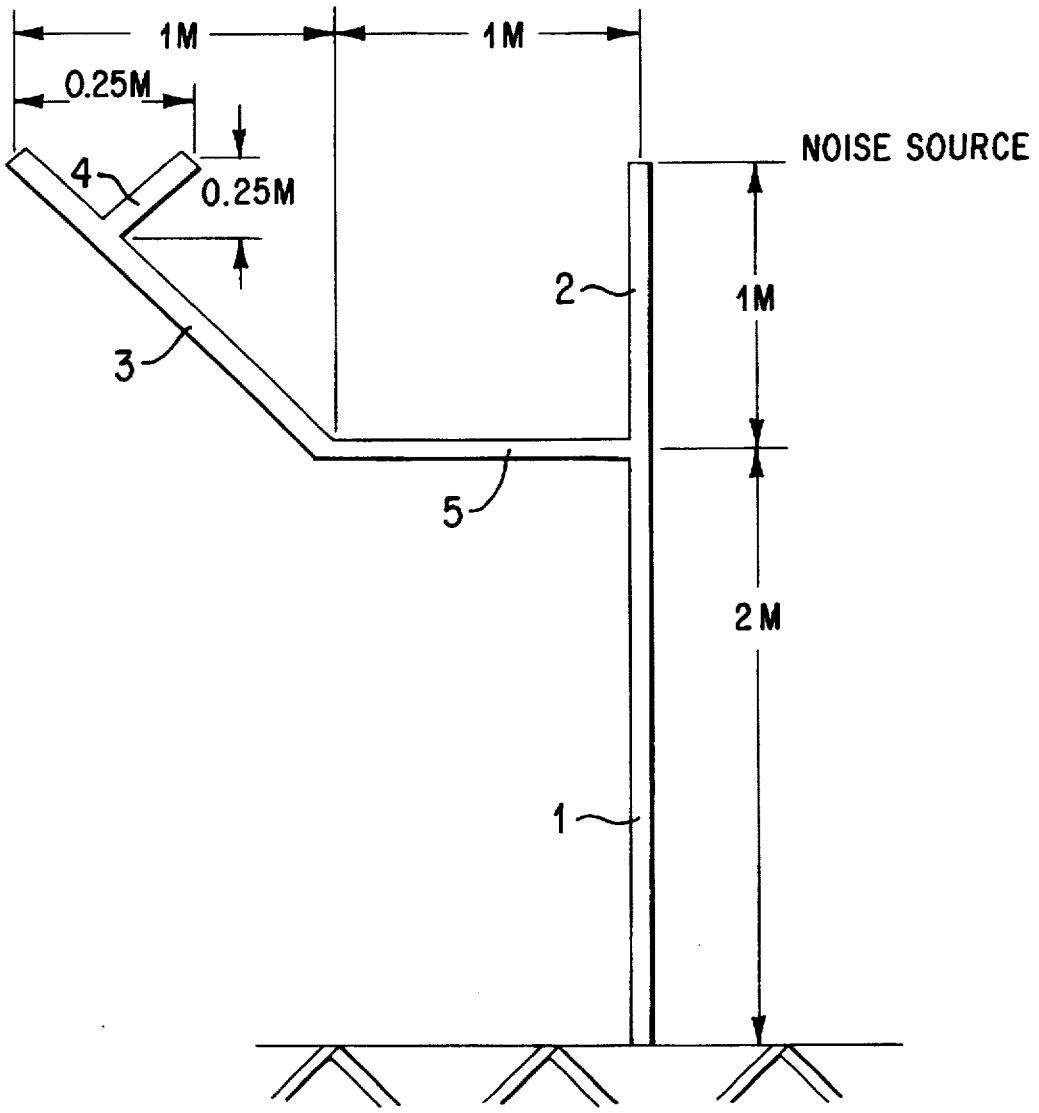
FIG. 1 is a side elevation of a first embodiment of a soundproof wall according to the present invention.

FIG. 1 is a side elevation view of the soundproof wall according to the first embodiment. This soundproof wall is designed for installation along a noise source such as a railway, road, etc. As shown, the soundproof wall comprises a main wall 1 to be installed along the noise source, a first branch wall 2 installed generally vertically on the top of the main wall 1, a second branch wall 3 extending obliquely upward away from the noise source and having a horizontal portion 5 connected to the main wall 1 and first branch wall 2 and which extends horizontally away from the noise source, and a third branch wall 4 installed at an intermediate height of the inner side of the second branch wall 3 and which extends upward obliquely toward the noise source. It is assumed that the noise source exists to the right of the main wall 1 as viewed in FIG. 1, and the side of each of these walls toward the noise source will be referred to as "inner side" while the side away from the noise source will be referred to as "outer side" hereinafter.

Figure 2:
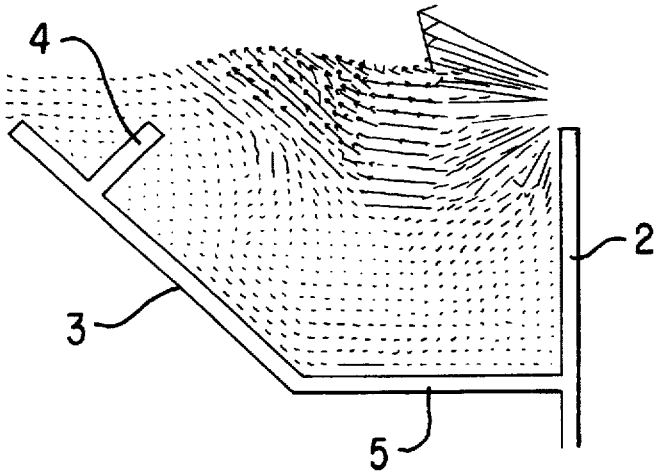
FIG. 2 shows an acoustic intensity distribution of the soundproof wall according to the first embodiment shown in FIG. 1.

FIG. 2 shows the result of a calculation, by the boundary element method, of a flow of 250-Hz octave-band acoustic energy (acoustic intensity) traveling along the soundproof wall having the geometric structure as shown in FIG. 1. Acoustic intensity vectors are indicated with arrows. The third branch wall 4 functions to suppress the sound traveling along the second branch wall 3 located in an opposite position to the noise source. In FIG. 2, the directions of arrows are those of acoustic energy, and the longer arrows indicate larger acoustic energies. FIG. 2 shows that the sound wave from the noise source has the energy thereof drastically attenuated when traveling outwardly over the third branch wall 5. More specifically, the sound traveling along the second branch wall 3 is forced upward by the third branch wall 4, and interferes, at the top of the third branch wall 4, with the sound (direct sound wave) traveling as diffracted over the top of the first branch wall 2 toward the top of the third branch wall 4, resulting in an attenuation of the acoustic energy. As in the above, since the sound diffracted above the top of the soundproof wall is thus suppressed, great noise suppression is attained at a place behind the sound proof wall as viewed from the noise source.

Figure 3:
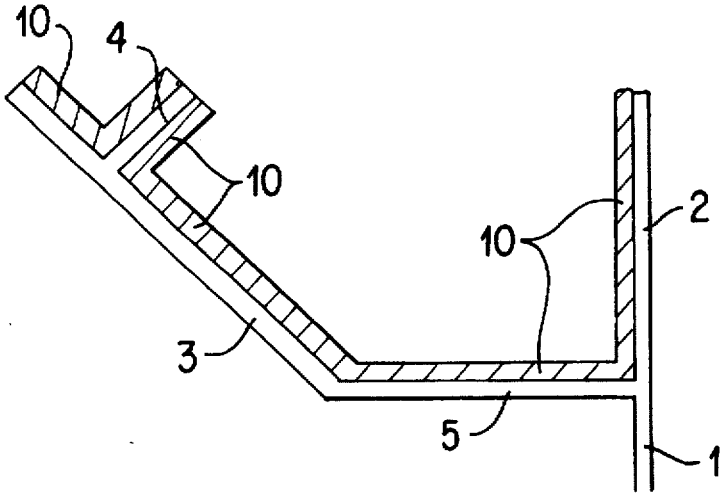
FIG. 3 is a side elevation view of the soundproof wall according to the first embodiment shown in FIG. 1, having a sound absorbing member attached on the outer side of a first branch wall thereof, upper side of a second branch wall and both the inner and outer sides of a third branch wall.

FIG. 3 shows the soundproof wall according to the first embodiment, having a sound absorbing member 10 attached on the outer side of the first branch wall 2 thereof, upper side of the second branch wall 3, and on both the inner and outer sides of the third branch wall 4. The sound absorbing member 10 may be made of a rock wool, glass wool, ceramic, expanded concrete or the like. The sound absorbing member 10 is attached to each wall surface by bolting, pinning, striking with adhesive, enclosing with perforated plate, wire-netting or the like which is selected depending upon the material of the sound absorbing member 10.

Figure 4:
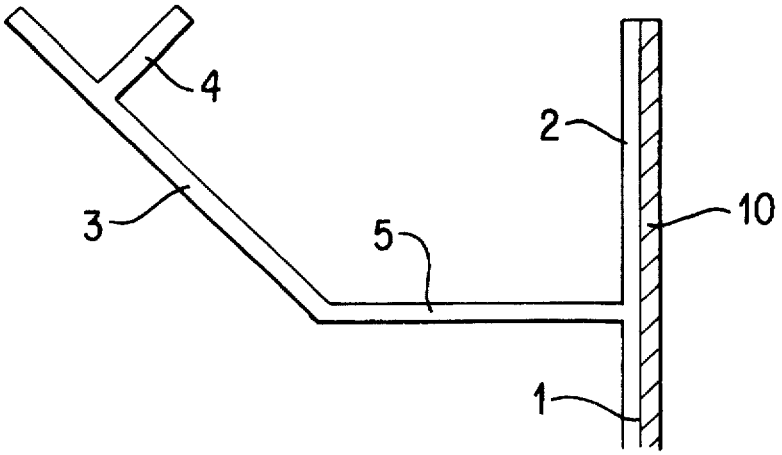
FIG. 4 is a side elevation view of the soundproof wall according to the first embodiment, having the sound absorbing member attached on the inner sides of a main wall and first branch wall, respectively, facing a noise source.

FIG. 4 shows the soundproof wall, according to the first embodiment, having the sound absorbing member 10 attached on the inner sides of the main wall 1 and first branch wall 2, respectively, facing the noise source.

Figure 5:
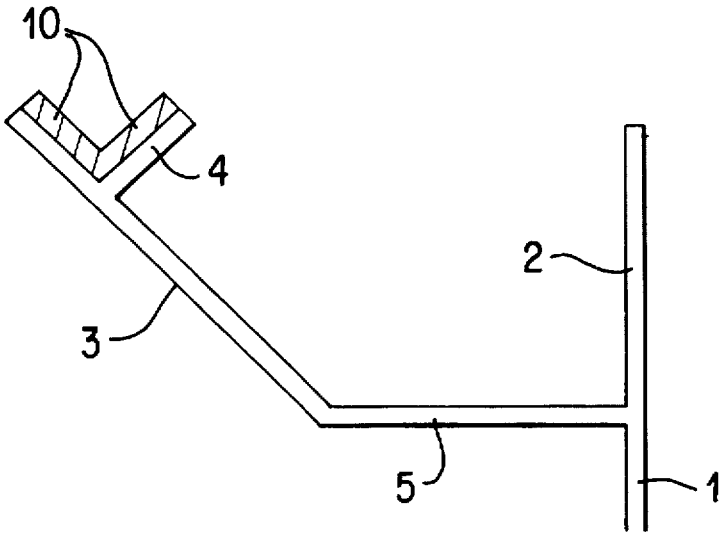
FIG. 5 is a side elevation view of the soundproof wall according to the first embodiment, having the sound absorbing member attached on the upper side of a portion of the second branch wall as well as on the upper side of the third branch wall.

FIG. 5 shows the soundproof wall, according to the first embodiment, having the sound absorbing member 10 attached only on the upper side of a portion of the second branch wall 3 and on the upper side of the third branch wall 4.

Figure 6:
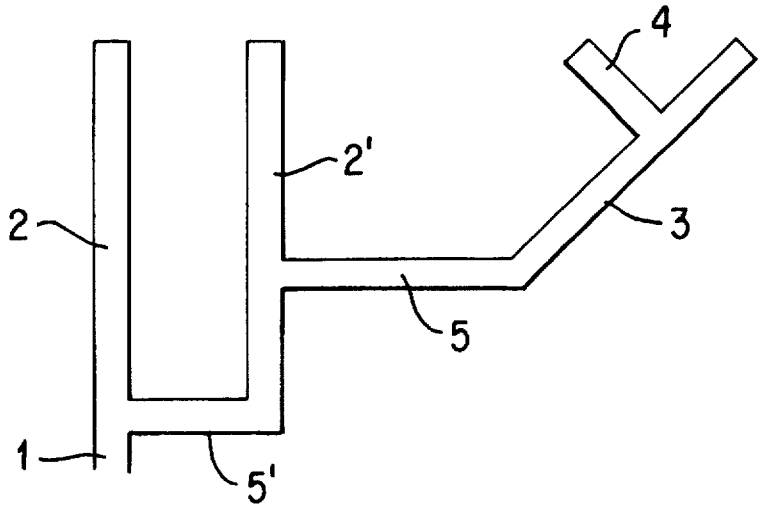
FIG. 6 is a side elevation view of a second embodiment of the present invention.
Figure 7:
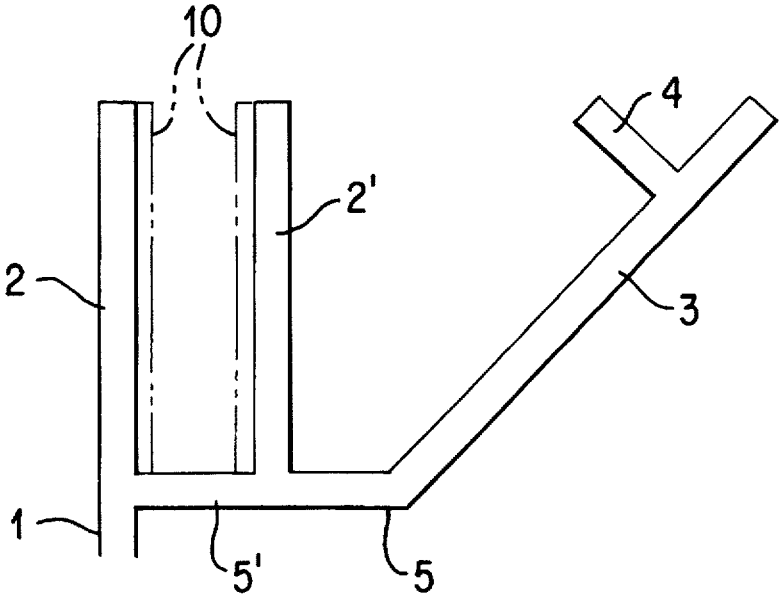
FIG. 7 is a side elevation view of a variant of the second embodiment of the present invention.

FIGS. 6 and 7 show a second embodiment of the soundproof wall according to the present invention and a variant thereof, respectively. In the second embodiment, the soundproof wall comprises the main wall 1 which is to be installed along a noise source, a first vertical branch wall 2 installed generally vertically on the top of the main wall 1, a second vertical branch wall 2' having a horizontal portion 5' connected to the main wall 1 and first vertical branch wall 2 and which extends out horizontally away from the noise source, second branch wall 3 extending obliquely upward away from the noise source and having another horizontal portion 5 connected to an intermediate height of the second vertical branch wall 2' and which extends out horizontally away from the noise source, and the third branch wall 4 installed at an intermediate height of the second branch wall 3 and extending obliquely toward the noise source.

As seen, the second vertical branch wall 2' is connected to the main wall 1 and first vertical branch wall 2 by means of the first horizontal portion 5' extending out horizontally away from the noise source. The second branch wall 3 is connected to an intermediate height of the second vertical branch wall 2' by means of the second horizontal portion 5 and extends out obliquely from the second horizontal portion 5.

In the variant of the second embodiment shown in FIG. 7, the second horizontal portion 5 extends out contiguously from the horizontal portion 5' in the direction opposite to the noise source, not from the intermediate height of the second vertical branch wall 2'.

Also, the sound absorbing member 10 may be attached on the outer side of the first vertical branch wall 2 and inner side of the second vertical branch wall 2'. The sound absorbing member 10 may also be attached on the inner side of the first vertical branch wall 2 and outer side of the second vertical branch wall 2' or on the inner or outer side of the third branch wall 4. Further, the sound absorbing member 10 may be attached on the inner or outer side of the second branch wall 3. Thus, a location of the sound absorbing member 10 may be freely selected.

Note that it is assumed the noise source exists to the left of the main wall 1 as viewed in FIGS. 6 and 7.

In the following description of the third through eighth embodiments of the present invention illustrated in FIGS. 8 through 13, it is assumed that the noise source exists to the right of the main wall 1 as viewed in these figures.

Figure 8:
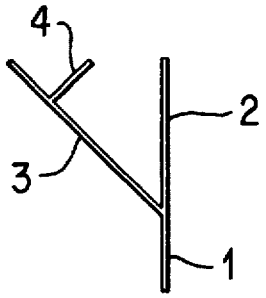
FIG. 8 is a side elevation view of a third embodiment of the present invention.

In the third embodiment shown in FIG. 8, the first branch wall 2 extends upward vertically from the top of the main wall 1. This embodiment does not include the horizontal portion 5. The second branch wall 3 is connected directly to the main wall 1 and second branch wall 2 and extends out obliquely away from the noise source. The third branch wall 4 is connected to an intermediate height of the second branch wall 3 and extends upward obliquely toward the noise source. In this embodiment, the sound absorbing member 10 may be attached on a selected wall side or sides.

Figure 9:
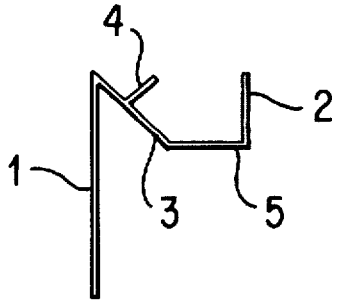
FIG. 9 is a side elevation view of a fourth embodiment of the present invention.

In the fourth embodiment shown in FIG. 9, the main wall 1 has installed on the top thereof an assembly of the second branch wall 3 extending obliquely down toward the noise source and having the horizontal portion 5 connected to the top of the main wall 1, first branch wall 2 extending vertically from the end of the horizontal portion 5, and the third branch wall 4 installed at an intermediate height of the second branch wall 3 and extending upward obliquely toward the noise source. Also in this embodiment, the sound absorbing member 10 may be attached on a selected wall side or sides.

Figure 10:
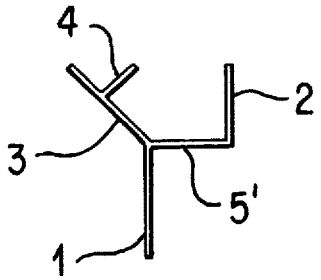
FIG. 10 is a side elevation view of a fifth embodiment of the present invention.

In the fifth embodiment shown in FIG. 10, the main wall 1 has installed on the top thereof an assembly of the second branch wall 3 extending upward obliquely away from the noise source and having the horizontal portion 5 connected to the top of the main wall 1 at the boundary between the obliquely extending portion and horizontal portion of the second branch wall 3, first branch wall 2 extending vertically from the end of the horizontal portion 5, and the third branch wall 4 installed at an intermediate height of the second branch wall 3 and which extends ends upward obliquely toward the noise source. Also in this embodiment, the sound absorbing member 10 may be attached on a selected all side or sides.

Figure 11:
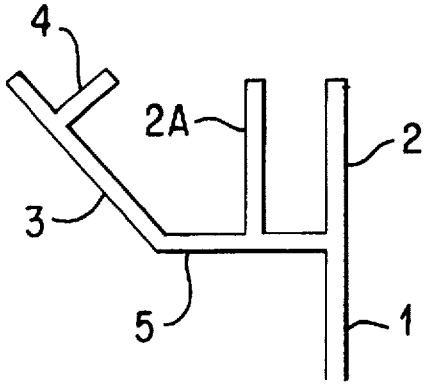
FIG. 11 is a side elevation view of a sixth embodiment of the present invention.

In the sixth embodiment shown in FIG. 11, the horizontal portion 6 has installed at an intermediate portion thereof a fourth branch wall 2A extending vertically upward in parallel with the first branch wall 2.

Figure 12:
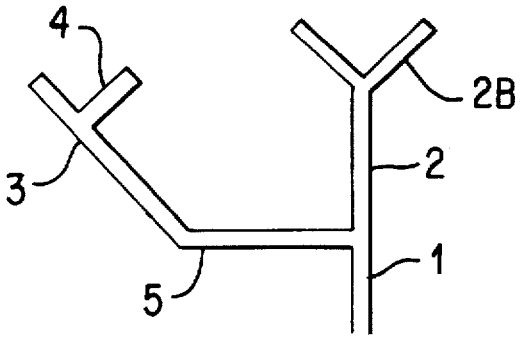
FIG. 12 is a side elevation view of a seventh embodiment of the present invention.

In the seventh embodiment shown in FIG. 12, the second branch wall 2 has installed on the top thereof a fourth branch wall 2B of which the cross-section is a "V" shape.

In the aforementioned third to seventh embodiments, the main wall 1 of the soundproof wall is an upright one. However, the main wall 1 may be of a bent-top type or curved-top type which have previously been described.

Figure 13:
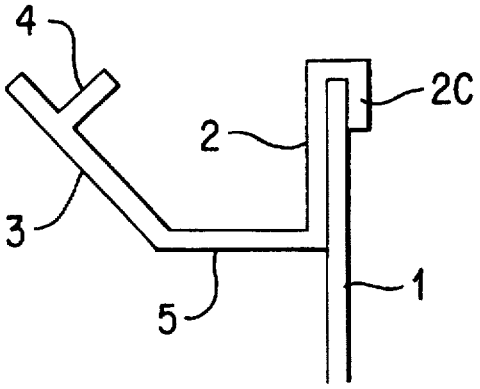
FIG. 13 is a side elevation view of an eighth embodiment of the present invention.

According to the eighth embodiment shown in FIG. 13, the first branch wall 2 has installed on the top thereof a mount 2C which supports the assembly of the first branch wall 2, second branch wall 3 with the vertical portion 5, and the third branch wall 4.

Figure 14:
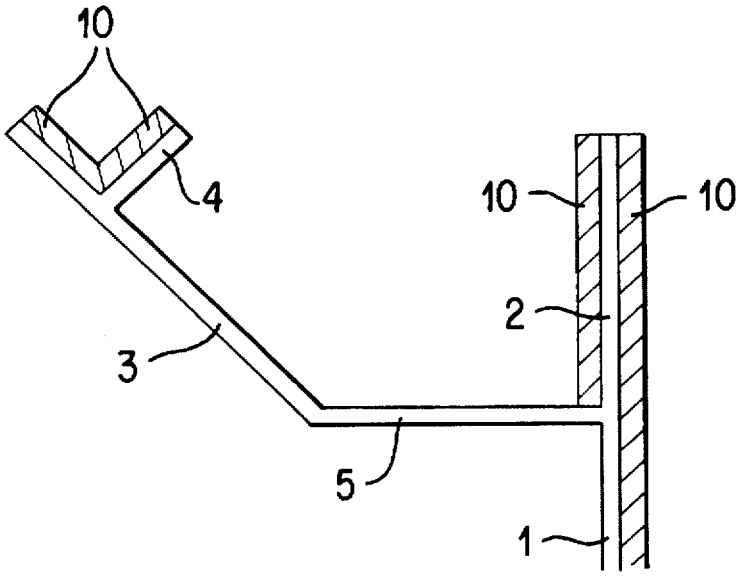
FIG. 14 is a side elevation view of the soundproof wall according to the first embodiment, having the sound absorbing member attached on the upper side of a portion of the second branch wall as well as on the upper side of the third branch wall, on the outer side of the main wall, and on both the inner and outer sides of the first branch wall.
Figure 15:
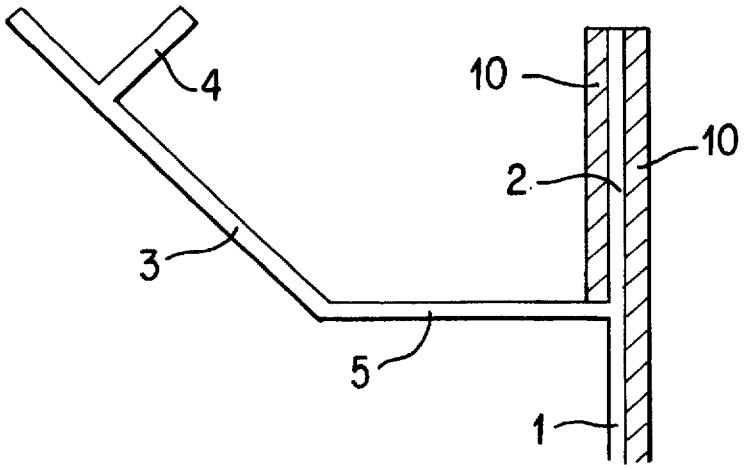
FIG. 15 is a side elevation view of the soundproof wall according to the first embodiment, having the sound absorbing member attached on the outer side of the main wall, and on both the inner and outer sides of the first branch wall.

FIGS. 14 and 15 show examples of attached wound absorbing members 10.

Figure 16:
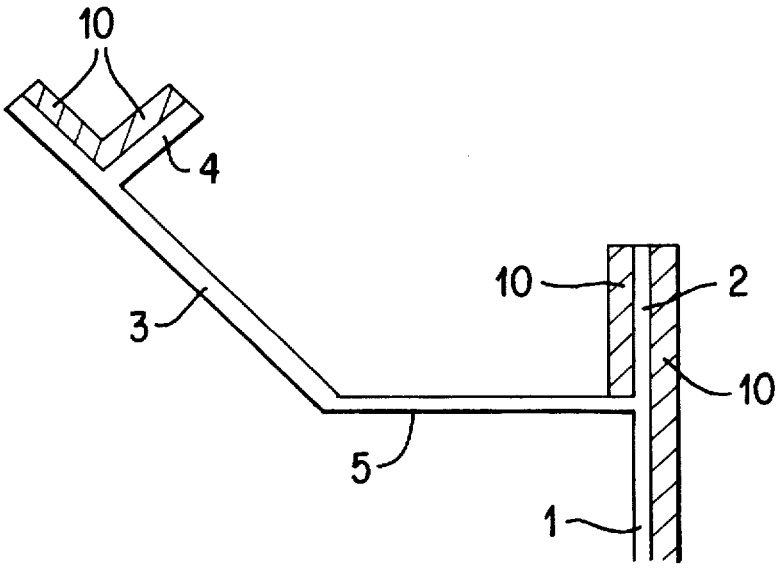
FIG. 16 is a side elevation view of a ninth embodiment of the present invention.
Figure 17:
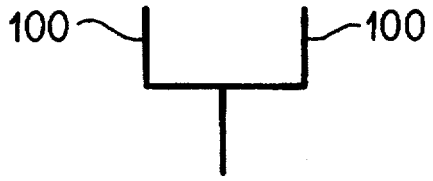
FIG. 17 PRIOR ART
FIG. 17 is a side elevation view of a conventional soundproof wall.
Figure 18:
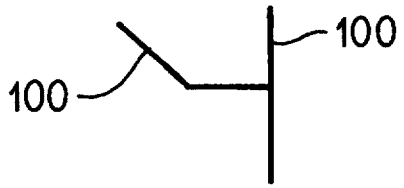
FIG. 18 PRIOR ART
FIG. 18 is a side elevation view of another conventional soundproof wall.
Figure 19:
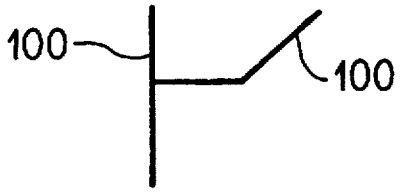
FIG. 19 PRIOR ART
FIG. 19 is a side elevation view of still another convebtional soundproof wall.
Figure 20:
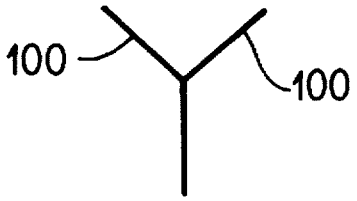
FIG. 20 PRIOR ART
FIG. 20 is a side elevation view of a yet another conventional soundproof wall.

FIG. 16 shows the ninth embodiment of the soundproof wall according to the present invention in which the top end of the second branch wall 3 is designed higher than the top end of the second branch wall 2 to enhance the effect of noise control of the soundproof wall.

Figure 21:
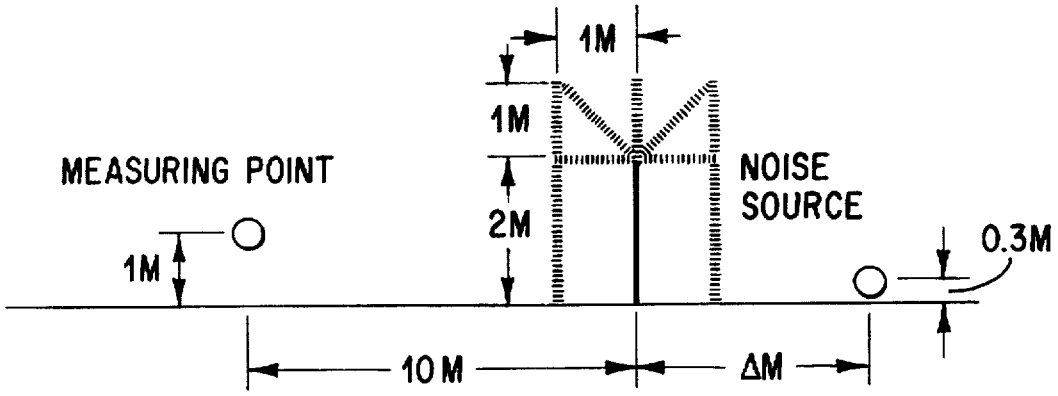
FIG. 21 is an explanatory drawing showing how to measure the effect of sound attenuation.
Figure 22:
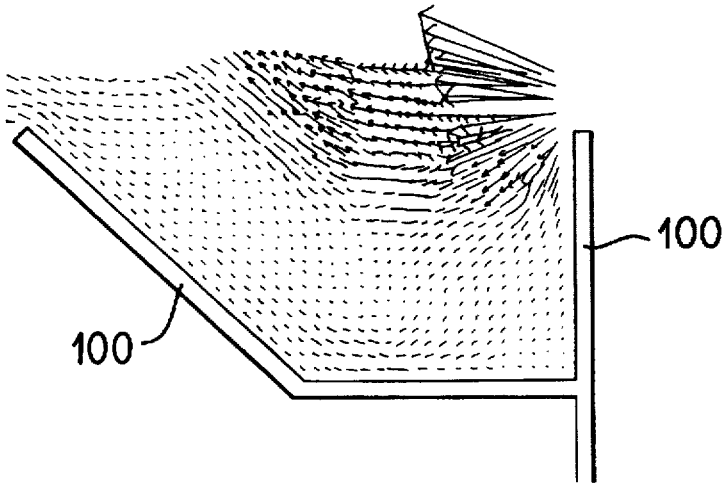
FIG. 22 PRIOR ART
FIG. 22 shows an acoustic intensity distribution by the conventional soundproof walls in FIGS. 17 through 20.

FIGS. 17 to 20 show the constructions of conventional soundproof walls and FIG. 21 shows the method of measuring the effect of sound attenuation of the conventional soundproof walls. As a sound source a speaker was placed at a distance of 4 meters from the soundproof wall. To measure the noise attenuation of the soundproof wall a microphone was placed behind the soundproof wall as viewed from the noise source and in a position of 10 meters from the soundproof wall. Noise measurement was done with a sound generated at each of 250 Hz-, 500 Hz- and 1 kHz-octave bands. FIG. 22 shows the acoustic intensity distribution by the conventional soundproof wall shown in FIG. 18. As shown, the sound diffracted at the end of the auxiliary wall 100 facing the noise source travels along the oblique auxiliary wall 100. As apparent from comparison with the acoustic intensity distribution shown in FIG. 2, the conventional soundproof wall has no means of suppressing the sound traveling along the oblique auxiliary wall 100 while the soundproof wall according to the present invention is provided with the third branch wall 4 which further enhances the sound attenuation by the soundproof wall. Sound measurement, similar to that shown in FIG. 21, was done with the embodiments shown in FIGS. 1, 3 and 5, respectively. The results of the measurements are shown in Table 1.

TABLE 1

Sound attenuation by soundproof walls (in dB)

| Soundproof wall | 250 HZ | 500 HZ | 1 Khz |
|---|---|---|---|
| No. 1 embodiment (FIG. 1) | 8 | 9 | 12 |
| No. 1 embodiment with sound absorbing member (FIG. 3) | 10 | 12 | 15 |
| No. 2 embodiment (FIG. 5) | 10 | 11 | 14 |
| Conventional one (FIG. 17) | 5 | 6 | 8 |
| Conventional one (FIG. 18) | 7 | 7 | 9 |
| Conventional one (FIG. 19) | 5 | 6 | 8 |
| Conventional one (FIG. 20) | 4 | 6 | 8 |

Table 1 shows the measured values of sound attenuation in comparison with those attained only by a conventional upright soundproof wall of 3 meters in height.

What is claimed is:

1. A soundproof wall for attenuating sound or noise coming from a noise source, comprising:

a main wall having the noise source on one side thereof;

a first branch wall extending vertically from a top of said main wall;

a second branch wall extending obliquely from the top of said main wall and away from the noise source; and a third branch wall extending from an intermediate position along the height of said second branch wall obliquely upward toward said noise source.

2. A soundproof wall according to claim 1, further comprising a sound absorbing member attached on the inner or outer side of at least one of said first, second and third branch walls.

* * * * *